US011056071B2

(12) United States Patent
Ryu et al.

(10) Patent No.: US 11,056,071 B2
(45) Date of Patent: Jul. 6, 2021

(54) DISPLAY DEVICE AND METHOD OF DRIVING THE SAME

(71) Applicant: LG DISPLAY CO., LTD., Seoul (KR)

(72) Inventors: Sung-Bin Ryu, Paju-si (KR); Jun-Ho Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 171 days.

(21) Appl. No.: 15/838,865

(22) Filed: Dec. 12, 2017

(65) Prior Publication Data

US 2018/0182346 A1 Jun. 28, 2018

(30) Foreign Application Priority Data

Dec. 26, 2016 (KR) ..... 10-2016-0178752

(51) Int. Cl.
*G09G 3/36* (2006.01)
*G09G 3/3233* (2016.01)

(52) U.S. Cl.
CPC ..... *G09G 3/3688* (2013.01); *G09G 3/3233* (2013.01); *G09G 3/3659* (2013.01); *G09G 3/3677* (2013.01); *G09G 2300/0819* (2013.01); *G09G 2300/0861* (2013.01); *G09G 2310/0251* (2013.01); *G09G 2310/0262* (2013.01)

(58) Field of Classification Search
CPC .. G09G 3/3688; G09G 3/3233; G09G 3/3677; G09G 3/3659; G09G 2300/0819; G09G 2300/0861; G09G 2310/0262; G09G 2310/0251
See application file for complete search history.

(56) References Cited

U.S. PATENT DOCUMENTS 8,760,442 B2 * 6/2014 Yamazaki ..... G09G 3/3648 345/204
2012/0300149 A1 11/2012 Hsu et al.
2014/0139566 A1 * 5/2014 Han ..... G09G 5/10 345/691
2015/0154941 A1 * 6/2015 Kanda ..... G09G 5/18 345/213
2016/0196789 A1 * 7/2016 Suyama ..... G09G 3/3688 345/209
2016/0365049 A1 * 12/2016 Uemura ..... G02F 1/136286

FOREIGN PATENT DOCUMENTS

CN 102129843 A 7/2011
CN 102770903 A 11/2012
CN 103050080 A 4/2013
CN 103295525 A 9/2013
JP 2008-107772 A 5/2008

* cited by examiner

*Primary Examiner* — Kent W Chang
*Assistant Examiner* — Andrew Lee
(74) *Attorney, Agent, or Firm* — Birch, Stewart, Kolasch & Birch, LLP

(57) ABSTRACT

A display device according to an embodiment includes a driving unit generating an nth primary gate voltage, an nth secondary gate voltage and a data voltage during a plurality of driving frames; and a display panel storing a threshold voltage using the nth primary gate voltage, the nth secondary gate voltage and the data voltage during the plurality of driving frames and displaying an image using a sum of the data voltage and the threshold voltage during a plurality of staying frames after the plurality of driving frames, wherein a sampling period for storing the threshold voltage of one of the plurality of driving frames is shorter than at least one sampling period of others of the plurality of driving frames.

10 Claims, 9 Drawing Sheets

DISPLAY DEVICE AND METHOD OF DRIVING THE SAME

CROSS-REFERENCE TO RELATED APPLICATION

The present application claims the benefit of priority of Korean Patent Application No. 10-2016-0178752 filed in the Republic of Korea on Dec. 26, 2016, which is hereby incorporated by reference in its entirety for all purposes as if fully set forth herein.

BACKGROUND

Field of the Disclosure

The present disclosure relates to a display device, and more particularly to a display device and a method of driving the display device including a plurality of driving frames in a low frequency driving.

Discussion of the Background

Recently, as the information society progresses, display devices for processing and displaying a large amount of information have rapidly advanced and various flat panel displays (FPDs) have been developed. For example, the FPDs include a liquid crystal display (LCD) device, a plasma display panel (PDP) device, a field emission display (FED) device, and an organic light emitting diode (OLED) display device.

Among various FPDs, the OLED display device, which may be referred to as an organic electroluminescent display (OELD) device, has been the subject of recent research due to its advantages such as a high brightness, a low driving voltage, an emissive type, a short response time, a wide viewing angle, a low temperature operation and a simple fabrication process.

In general, the display device receives a clock with an input frequency of 60 Hz and is driven according to the input frequency.

The display device is driven with substantially the same frequency for a static image having a relatively small gray level change between frames as well as a moving image having a relatively great gray level change between frames. As a result, power consumption increases in the display device.

To reduce the power consumption, a variable refresh rate (VRR) driving method has been suggested. In the VRR driving method, an image having a relatively great gray level change between frames is driven with an input frequency or a frequency higher than the input frequency, and an image having a relatively small gray level change between frames is driven with a frequency lower than the input frequency, thereby reducing power consumption.

The VRR driving method may be more effectively applied to an element having an excellent off current property such as a thin film transistor of an oxide semiconductor.

A driving method of a display device will be discussed hereinafter.

FIG. 1 is a view showing a primary gate voltage and a data voltage of a display device in a low frequency driving according to the related art.

In FIG. 1, a display device according to the related art is driven with a frequency of 1 Hz. During a first frame F1 among first to sixtieth frames F1 to F60 constituting one second, an nth primary gate voltage Vga1(*n*) corresponding to an nth horizontal line of a display panel has a high level, and a data voltage Vda is applied to a pixel of the display panel. During the second to sixtieth frames F2 to F60, the nth primary gate voltage Vga1(*n*) has a low level, and the pixel of the display panel consistently displays the same image using the data voltage Vda stored in a storage capacitor.

During the first frame F1 of a driving frame, a driving unit operates to output the nth primary gate voltage Vga1(*n*) of the high level and the data voltage Vda, and the nth primary gate voltage Vga1(*n*) of the high level and the data voltage Vda voltage are supplied to the display panel. Next, during the second to sixtieth frames F2 to F60 of a staying frame, the driving unit stops operating not to output the nth primary gate voltage Vga1(*n*) of the high level and the data voltage Vda, and the nth primary gate voltage Vga1(*n*) of the high level and the data voltage Vda voltage are not supplied to the display panel. As a result, power consumption of the display device is reduced.

In the OLED display device, for a relatively long time period where a light emitting diode emits a light to display a gray level, a data voltage is applied to a gate of a driving thin film transistor (TFT) such that the driving TFT consistently has a turn-on state. The driving TFT may be deteriorated by the long turn-on operation.

Since the data voltage having the same polarity is applied to the gate of the driving TFT for a long time period (gate bias stress), an interface property between the gate and the gate insulator of the driving TFT is deteriorated. As a result, a threshold voltage of the driving TFT is changed and the gray level of the light emitted from the light emitting diode is changed, thereby a display quality of an image deteriorated.

To compensate the threshold voltage variance of the driving TFT, an inner compensation pixel structure where a present threshold voltage is stored in a storage capacitor and is added to the data voltage has been suggested.

The inner compensation pixel structure requires a sampling period for sensing the present threshold voltage. In the OLED display device according to the related art driven with a frequency of 1 Hz, since the nth primary gate voltage Vga1(*n*) and the data voltage Vda are supplied during the first frame F1, the present threshold voltage should be sensed during the sampling period of the first frame F1.

However, when the threshold voltage has a relatively great variance, the present threshold voltage is not accurately sensed by the sampling period of one time and the threshold voltage variance is not sufficiently compensated. As a result, the image becomes dark or blurred and the display quality is deteriorated.

SUMMARY

Accordingly, the present disclosure is directed to a display device and a method of driving the same that substantially obviate one or more of problems due to limitations and disadvantages of the prior art.

In accordance with the present disclosure, as embodied and broadly described herein, the present disclosure provides a display device including a driving unit generating an nth primary gate voltage, an nth secondary gate voltage and a data voltage during a plurality of driving frames; and a display panel storing a threshold voltage using the nth primary gate voltage, the nth secondary gate voltage and the data voltage during the plurality of driving frames and displaying an image using a sum of the data voltage and the threshold voltage during a plurality of staying frames after the plurality of driving frames, wherein a sampling period for storing the threshold voltage of one of the plurality of driving frames is shorter than at least one sampling period of others of the plurality of driving frames.

In another aspect, the present disclosure provides a method of driving a display device, including generating an nth primary gate voltage, an nth secondary gate voltage and a data voltage during a plurality of driving frames; sensing a threshold voltage using the nth primary gate voltage, the nth secondary gate voltage and the data voltage during the plurality of driving frames; and displaying an image using a sum of the data voltage and the threshold voltage during a plurality of staying frames after the plurality of driving frames, wherein a sampling period of one of the plurality of driving frames is shorter than at least one sampling period of others of the plurality of driving frames.

It is to be understood that both the foregoing general description and the following detailed description are exemplary and explanatory and are intended to provide further explanation of the embodiments as claimed.

BRIEF DESCRIPTION OF THE DRAWINGS

The accompanying drawings, which are included to provide a further understanding of the disclosure and are incorporated in and constitute a part of this specification, illustrate embodiments and together with the description serve to explain the principles of the disclosure. In the drawings.

DETAILED DESCRIPTION

Reference will now be made in detail to the present disclosure, examples of which are illustrated in the accompanying drawings.

Figure 1:
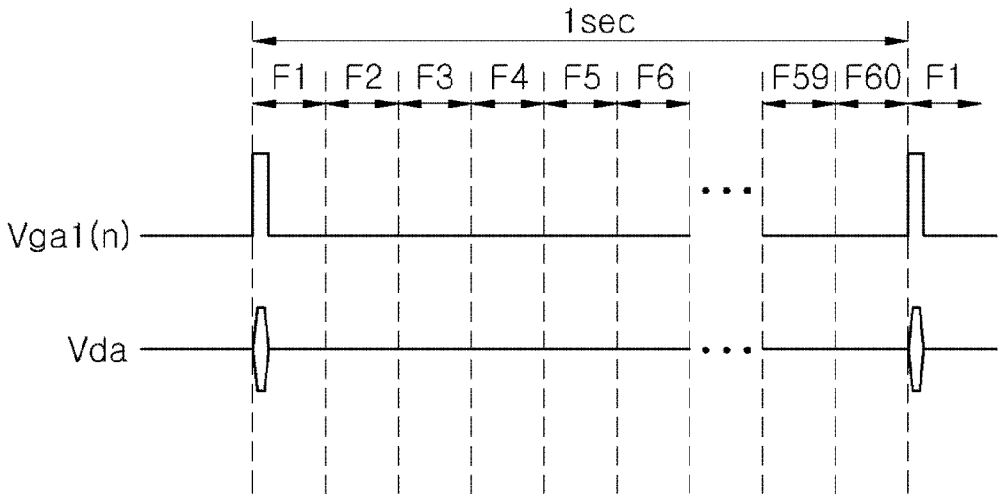
FIG. 1 Related Art
FIG. 1 is a view showing a primary gate voltage and a data voltage of a display device in a low frequency driving according to the related art.
Figure 2:
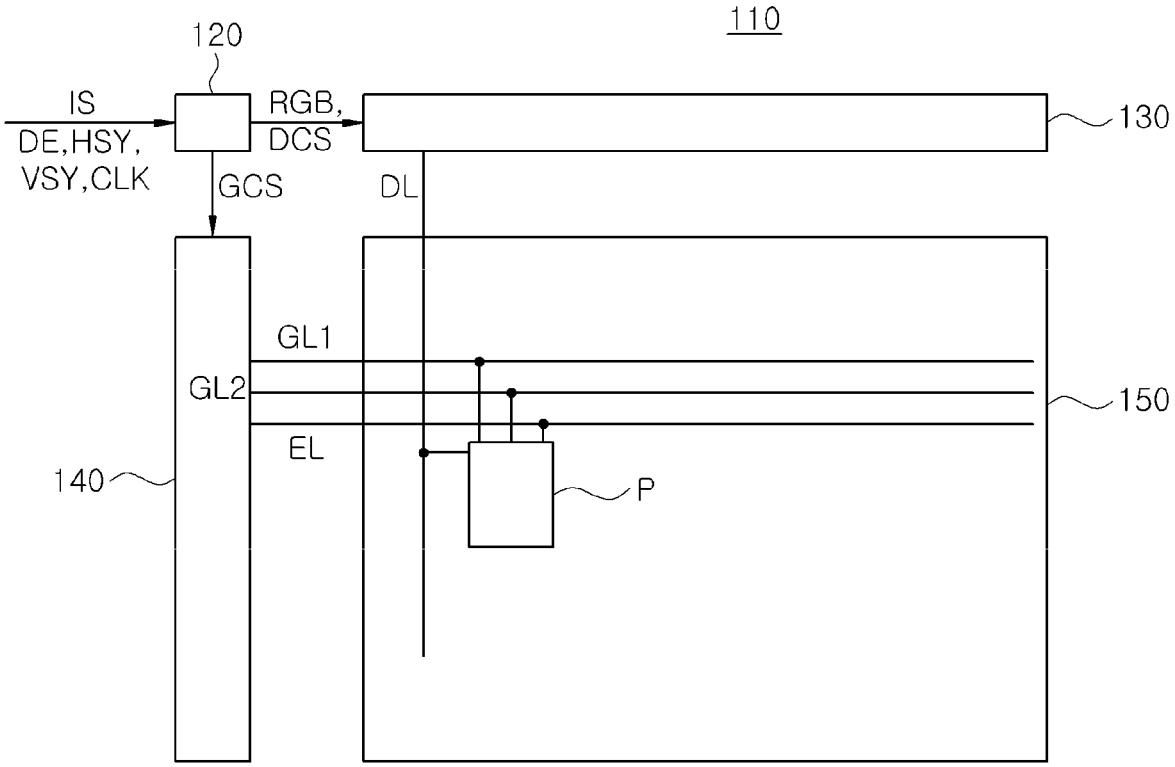
FIG. 2 is a view showing an organic light emitting diode display device according to a first embodiment of the present disclosure.
Figure 3:
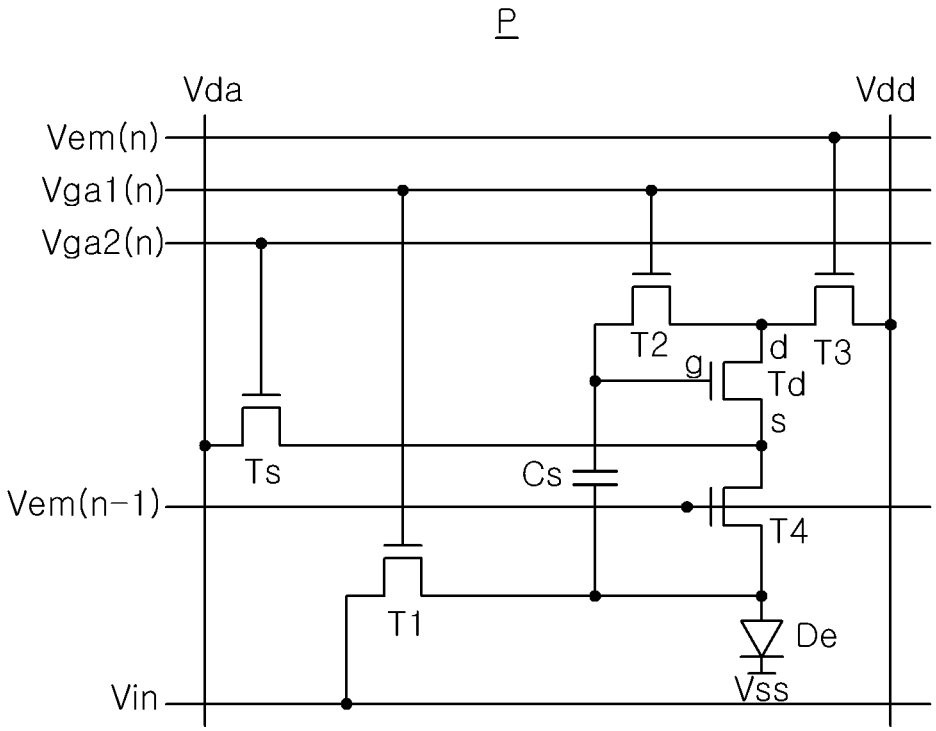
FIG. 3 is a view showing a pixel of the organic light emitting diode display device according to the first embodiment of the present disclosure.

FIG. 2 is a view showing an organic light emitting diode display device according to a first embodiment of the present disclosure, and FIG. 3 is a view showing a pixel of the organic light emitting diode display device according to the first embodiment of the present disclosure. All the components of the organic light emitting diode display device according to all embodiments of the present disclosure are operatively coupled and configured.

In FIG. 2, an organic light emitting diode (OLED) display device 110 includes a driving unit having a timing controlling part 120, a data driving part 130 and a gate driving part 140 and a display panel 150.

The timing controlling part 120 generates a gate control signal GCS, a data control signal DCS and an image data RGB using an image signal IS and a plurality of timing signals such as a data enable signal DE, a horizontal synchronization signal HSY, a vertical synchronization signal VSY and a clock CLK transmitted from an external system such as a graphic card or a television system. The timing controlling part 120 supplies the data control signal DCS and the image data RGB to the data driving part 130 and supplies the gate control signal GCS to the gate driving part 140.

The data driving part 130 generates a data voltage using the data control signal DCS and the image data RGB transmitted from the timing controlling part 120 and supplies the data voltage to a data line DL of the display panel 150.

The gate driving part 140 generates a primary gate voltage, a secondary gate voltage and an emission voltage using the gate control signal GCS transmitted from the timing controlling part 120 and supplies the primary gate voltage, the secondary gate voltage and the emission voltage to a primary gate line GL1, a secondary gate line GL2 and an emission line EL, respectively, of the display panel 150.

The display panel 150 displays an image using the primary gate voltage, the secondary gate voltage, the emission voltage and the data voltage. The display panel 150 includes the primary gate line GL1, the secondary gate line GL2, the emission line EL, the data line DL and a plurality of pixels P. The primary gate voltage, the secondary gate voltage, the emission voltage and the data voltage are applied to the primary gate line GL1, the secondary gate line GL2, the emission line EL, the data line DL, respectively, of the plurality of pixels P. The primary gate line GL1, the secondary gate line GL2, the emission line EL and the data line DL cross each other to define the plurality of pixels P.

The primary gate voltage and the secondary gate voltage are supplied to each pixel P through the primary gate line GL1 and the secondary gate line GL2, respectively. In addition, the emission voltage is supplied to each pixel P through the emission line EL and the data voltage is supplied to each pixel P through the data line DL.

The display panel 150 may further include a power line transmitting a high level voltage Vdd and an initialization line transmitting an initialization voltage Vin.

Since the plurality of pixels P have the same structure, an exemplary pixel P disposed in an nth horizontal line will be discussed now referring to FIG. 3.

In FIG. 3, one or each pixel P of the display panel 150 of the OLED display device 110 according to the first embodiment of the present disclosure includes a switching thin film transistor (TFT) Ts, a driving TFT Td, first to fourth TFT T1 to T4, a light emitting diode De and a storage capacitor Cs.

The switching TFT Ts is turned on or turned off according to the nth secondary gate voltage Vga2($n$) of the nth secondary gate line GL2($n$). In the examples herein, n is a natural number, e.g., a positive integer. A gate, a source and a drain of the switching TFT Ts are connected to the nth secondary gate line GL2(*n*), the data line DL and a source (s) of the driving TFT Td, respectively.

The driving TFT Td is switched according to a voltage of a first electrode of the storage capacitor Cs. A gate (g), the source (s) and a drain (d) of the driving TFT Td are connected to the first electrode of the storage capacitor Cs, a drain of the fourth TFT T4 and a source of the third TFT T3, respectively.

The first TFT T1 is switched according to the nth primary gate voltage Vga1(*n*). A gate, a source and a drain of the first TFT T1 are connected to the nth primary gate line GL1(*n*), the initialization line and a second electrode of the storage capacitor Cs, respectively.

The second TFT T2 is switched according to the nth primary gate voltage Vga1(*n*). A gate, a source and a drain of the second TFT T2 are connected to the nth primary gate line GL1(*n*), the drain d of the driving TFT Td and the first electrode of the storage capacitor Cs, respectively.

The third TFT T3 is switched according to the nth emission voltage Vem(n). A gate, a source and a drain of the third TFT T3 are connected to the nth emission line EL(n), the drain d of the driving TFT Td and the power line, respectively.

The fourth TFT T4 is switched according to the (n−1)th emission voltage Vem(n−1). A gate, a source and a drain of the fourth TFT T4 are connected to the (n−1)th emission line EL(n−1), the second electrode of the storage capacitor Cs and the source s of the driving TFT Td, respectively.

An anode of the light emitting diode De is connected to the source of the fourth TFT T4 and a cathode of the light emitting diode De is connected to a low level voltage Vss.

The first electrode of the storage capacitor Cs is connected to the gate g of the driving TFT Td and the second electrode of the storage capacitor Cs is connected to the initialization line.

For example, the nth primary gate voltage Vga1(*n*) may have a high level turning on the first and second TFTs T1 and T2 or a low level turning off the first and second TFT T1 and T2. The nth secondary gate voltage Vga2(*n*) may have a high level turning on the switching TFT Ts or a low level turning off the switching TFT Ts. The nth emission voltage Vem(n) may have a high level turning on the third TFT T3 or a low level turning off the third TFT T3. The (n−1)th emission voltage Vem(n−1) may have a high level turning on the fourth TFT T4 or a low level turning off the fourth TFT T4. The initialization voltage Vin may be a voltage keeping an initial value of the second electrode of the storage capacitor Cs constant.

A low frequency driving method and a threshold voltage sensing method of the OLED display device 110 will be now discussed below.

Figure 4:
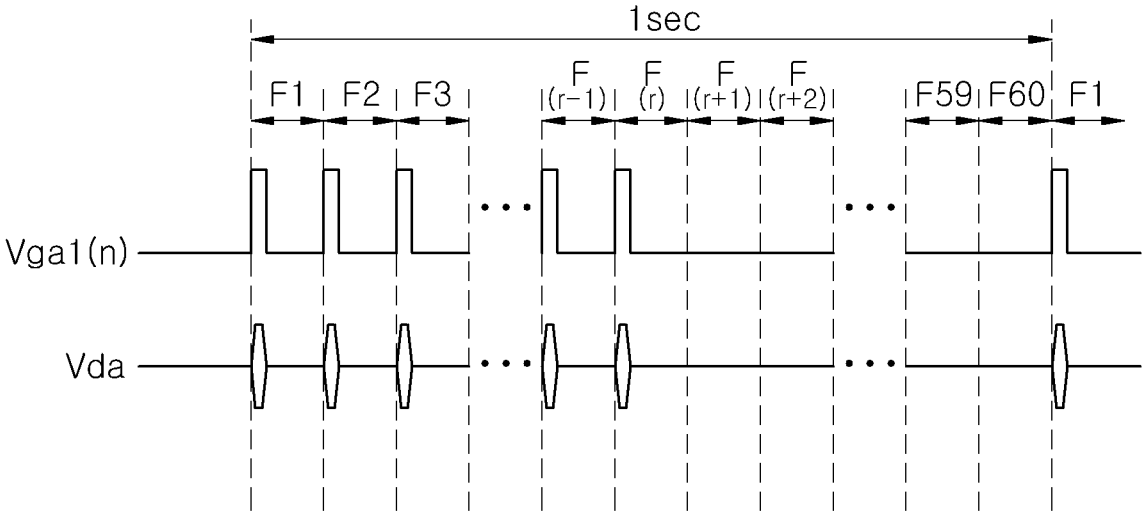
FIG. 4 is a view showing a primary gate voltage and a data voltage of a low frequency driving of the organic light emitting diode display device according to the first embodiment of the present disclosure.
Figure 5:
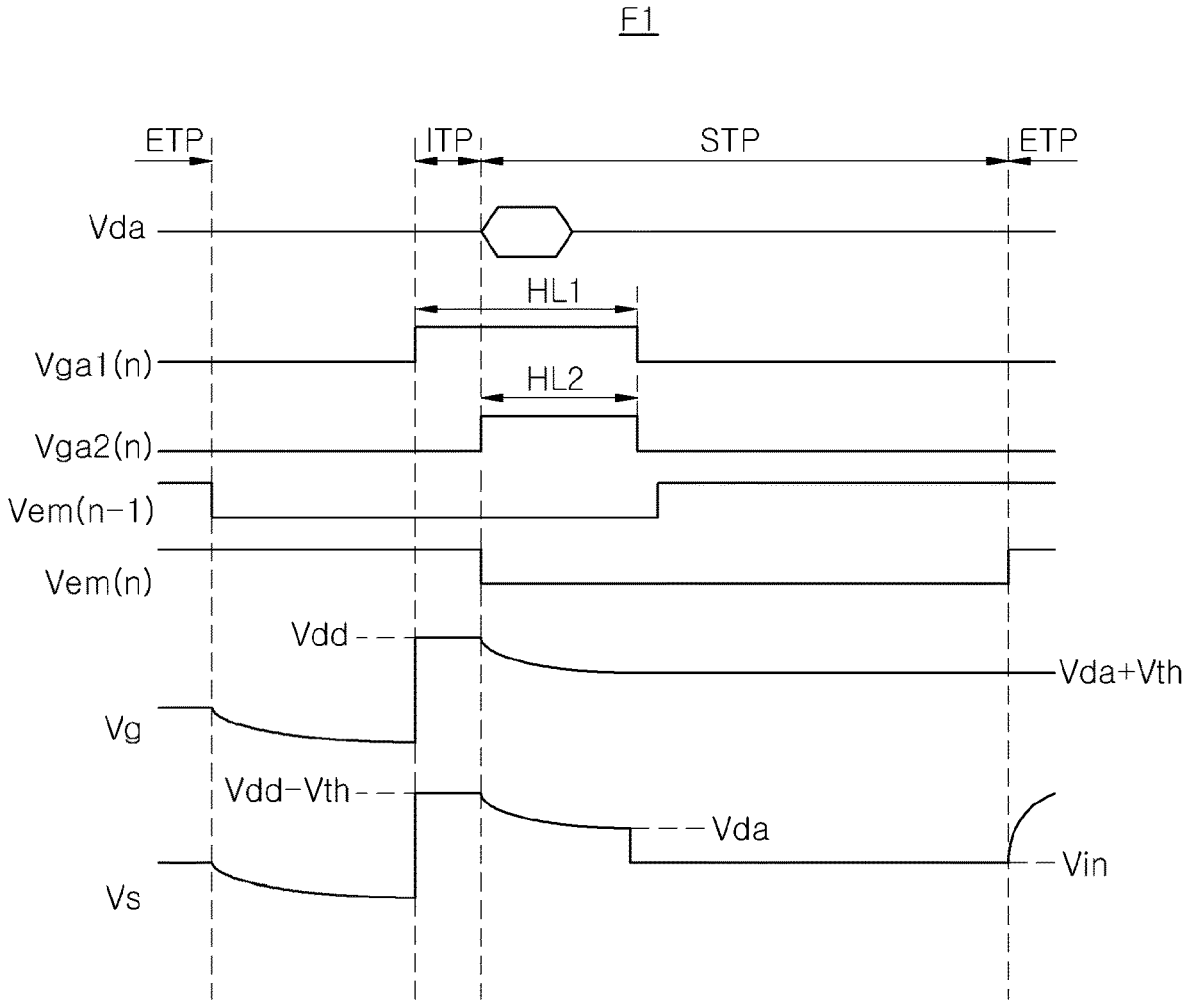
FIG. 5 is a view showing a plurality of voltages of one driving frame of the organic light emitting diode display device according to the first embodiment of the present disclosure.
Figure 6A:
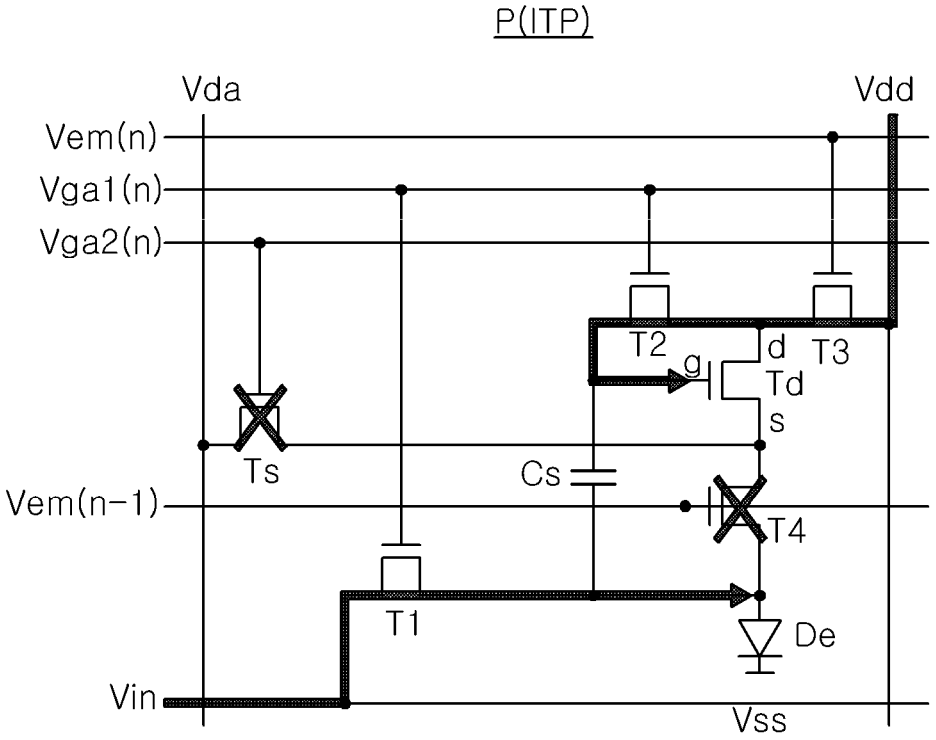
FIGS. 6A to 6C are views showing an operation state of one pixel of the organic light emitting diode display device according to the first embodiment of the present disclosure during an initialization period, a sampling period and an emission period, respectively, of one driving frame.
Figure 6B:
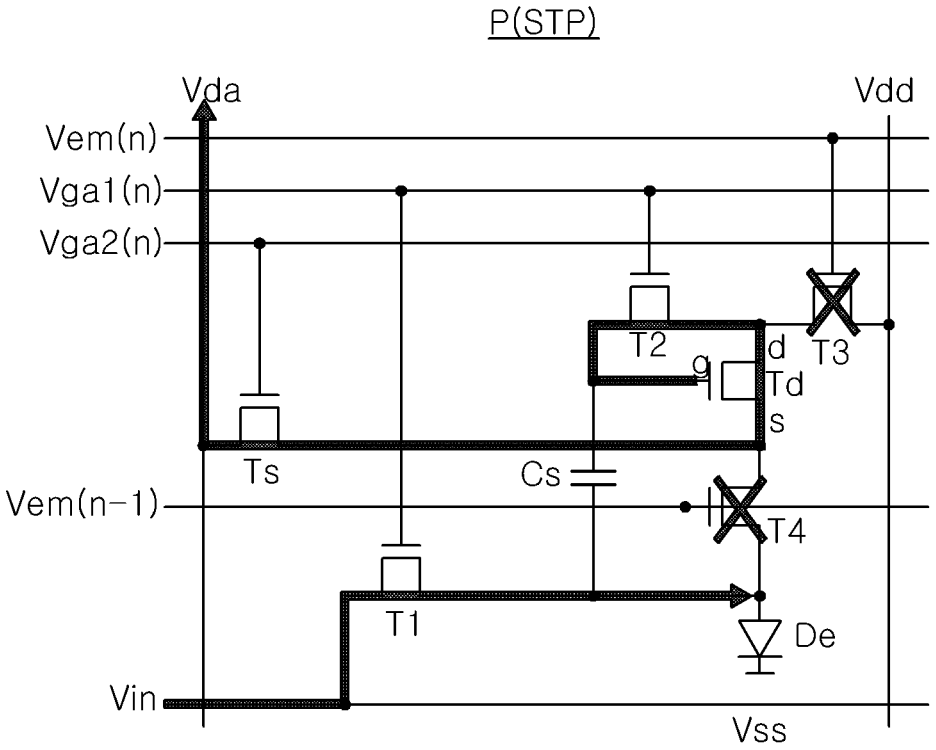
Figure 6C:
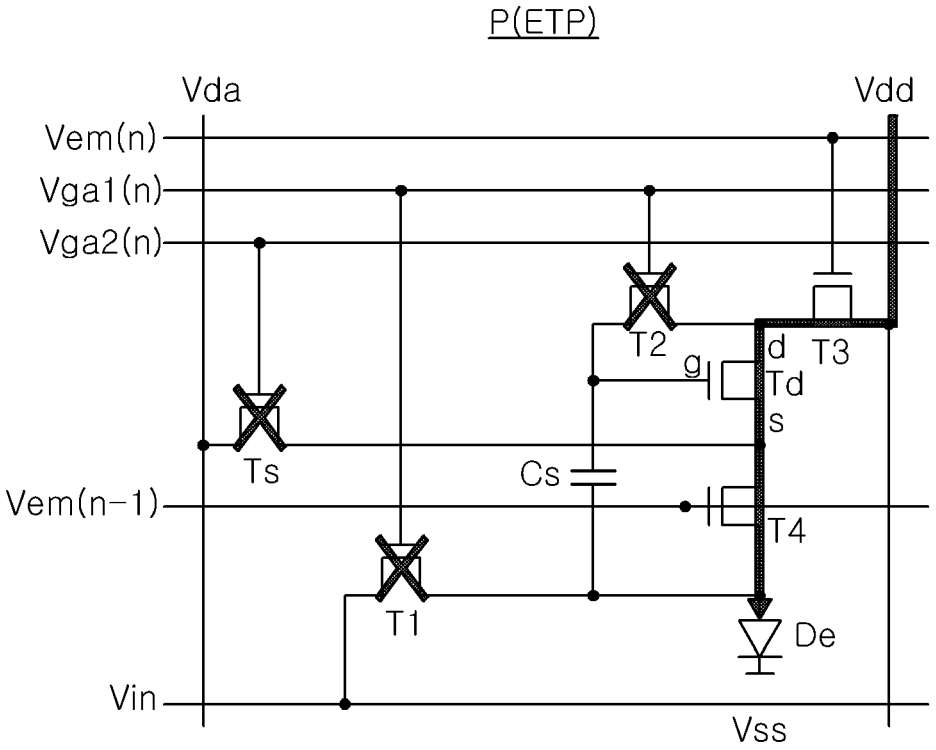

FIG. 4 is a view showing a primary gate voltage and a data voltage of a low frequency driving of the organic light emitting diode display device according to the first embodiment of the present disclosure, FIG. 5 is a view showing a plurality of voltages of one driving frame of the organic light emitting diode display device according to the first embodiment of the present disclosure, and FIGS. 6A to 6C are views showing an operation state of one pixel of the organic light emitting diode display device according to the first embodiment of the present disclosure during an initialization period, a sampling period and an emission period, respectively, of one driving frame.

In FIG. 4, when the OLED display device 110 is driven with a low frequency, during first to rth frames F1 to F(r), where r is an integer smaller than 60, among first to sixtieth frames F1 to F60 constituting one second, the nth primary gate voltage Vga1(*n*) applied to the nth primary gate line GL1(*n*) of the display panel 150 has a high level and the data voltage Vda is applied to the data line DL of the display panel 150. During (r+1)th to sixtieth frames F(r+1) to F60, the nth primary gate voltage Vga1(*n*) has a low level and the pixel P of the display panel 150 consistently displays the same image using a sum Vdata+Vth of the data voltage Vda and the threshold voltage Vth stored in the storage capacitor Cs.

During the first to rth frames F1 to F(r) of a driving frame, the timing controlling part 120, the data driving part 130 and the gate driving part 140 operate to output the nth primary gate voltage Vga1(*n*) of a high level and the data voltage Vda. The nth primary gate voltage Vga1(*n*) of a high level and the data voltage Vda are supplied to the nth primary gate line GL1(*n*) and the data line DL, respectively, of the display panel 150. In addition, during the (r+1)th to sixtieth frames F(r+1) to F60 of a staying frame, the timing controlling part 120, the data driving part 130 and the gate driving part 140 do not operate. Since the data driving part 130 and the gate driving part 140 output the nth primary gate voltage Vga1(*n*) of a low level and the nth primary gate voltage Vga1(*n*) of a low level is supplied to the nth primary gate line GL1(*n*) of the display panel 150, power consumption of the OLED display device 110 is reduced.

Further, since the threshold voltage Vth is sensed during the first to rth frames F1 to F(r), a present threshold voltage Vth is accurately detected.

Here, 'r' may be determined as a minimum frame number for accurately detecting the present threshold voltage Vth. For example, 'r' may be one of 5, 6 and 7.

In FIG. 5, the first frame F1 of a driving frame may include an initialization period ITP for initializing elements such as the storage capacitor Cs, a sampling period STP for sensing the threshold voltage and an emission period ETP for emitting from the light emitting diode De.

Here, the second to rth frames F2 to F(r) of a driving frame may be driven identically to the first frame F1. Lengths of the sampling period of the first to rth frames F1 to F(r) may be the same as each other. Specifically, lengths of a first high level section HL1 of the nth primary gate voltage Vga1(*n*) during the first to rth frames F1 to F(r) may be the same as each other, and lengths of a second high level section HL2 of the nth secondary gate voltage Vga2(*n*) during the first to rth frames F1 to F(r) may be the same as each other.

For example, the second high level section HL2 may be about 40% to about 70% of the first high level section HL1.

In FIGS. 5 and 6A, during the initialization period ITP, the switching TFT Ts and the fourth TFT T4 are turned off by the nth secondary gate voltage Vga2(*n*) and the (n−1)th emission voltage Vem(n−1) of a low level, and the first, second and third TFTs T1, T2 and T3 are turned on by the nth primary gate voltage Vga1(*n*) and the nth emission voltage Vem(n) of a high level.

As a result, the voltages of the second electrode of the storage capacitor Cs and the anode of the light emitting diode De may become the initialization voltage Vin, the voltages Vg and Vd of the gate g of the driving TFT Td and the drain d of the driving TFT Td may become the high level voltage Vdd, and the voltage Vs of the source s of the driving TFT Td may become a difference Vdd−Vth of the high level voltage Vdd and the threshold voltage Vth.

In FIGS. 5 and 6B, during the sampling period STP, the third and fourth TFTs T3 and T4 are turned off by the nth and (n−1)th emission gate voltages Vem(n) and Vem(n−1) of a low level, and the switching TFT Ts, the first TFT T1 and the second TFT T2 are turned on by the nth primary gate voltage Vga1(*n*) and the nth secondary gate voltage Vga2(*n*) of a high level.

As a result, the voltages of the second electrode of the storage capacitor Cs and the anode of the light emitting diode De may become the initialization voltage Vin, and the voltage Vs of the source s of the driving TFT Td may become the data voltage Vda. Since the driving TFT Td is turned on by the voltage Vg of the gate g of the driving TFT Td of the high level voltage Vdd, a current may flow from the gate g of the driving TFT Td to the source s of the driving TFT Td through the drain d of the driving TFT TD.

Due to the current flow, the voltages Vg and Vd of the gate g and the drain d of the driving TFT Td are gradually reduced. When the voltage Vg of the gate g of the driving TFT Td becomes a sum Vda+Vth of the data voltage Vda and the threshold voltage Vth, the driving TFT Td is turned off and the current flow is blocked and also the sum Vda+Vth of the data voltage Vda and the threshold voltage Vth as the voltage Vg of the gate g of the driving TFT Td is stored in the storage capacitor Cs.

In an end portion of the sampling period STP, the (n−1)th emission voltage Vem(n−1) may become a high level to turn on the fourth TFT T4 and the voltage Vs of the source s of the driving TFT Td may become the initialization voltage Vin.

In FIGS. 5 and 6C, during the emission period ETP, the switching TFT Ts, the first TFT T1 and the second TFT T2 are turned off by the nth primary gate voltage Vga1(*n*) and the nth secondary gate voltage Vga2(*n*) of a low level, and the third and fourth TFTs T3 and T4 are turned on by the nth emission voltage Vem(n) and the (n−1)th emission voltage Vem(n−1) of a high level.

In addition, the driving TFT Td is turned on by the sum Vda+Vth of the data voltage Vda and the threshold voltage Vth to correspond to the data voltage Vda.

As a result, a current corresponding to the data voltage Vda may flow the driving TFT Td using the high level voltage Vdd as a power source. The current may pass through the fourth TFT T4 to be applied to the light emitting diode De and the light emitting diode De may emit a light having a brightness corresponding to the data voltage Vda.

The voltage Vg of the gate g of the driving TFT Td is the sum Vda+Vth of the data voltage Vda and the threshold voltage Vth, and the voltage Vs of the source s of the driving TFT Td is the initialization voltage Vin. As a result, the difference Vgs between the gate g and the source s of the driving TFT Td becomes a value Vda+Vth−Vin by subtracting the initialization voltage Vin from the sum Vda+Vth of the data voltage Vda and the threshold voltage Vth, and an on current Ion of the driving TFT Td is proportional to a square of the difference Vda−Vin between the data voltage Vda and the initialization voltage Vin.

Since the current supplied to the light emitting diode De through the driving TFT Td becomes a value independent from the threshold voltage Vth, the OLED display device 110 may compensate the variance of the threshold voltage Vth to display an image of a uniform brightness.

In the OLED display device 110 according to the first embodiment of the present disclosure, during the plurality of driving frames of the beginning of a low frequency driving, the primary gate voltage Vga1, the secondary gate voltage Vga2, the emission voltage Vem and the data voltage Vda are supplied to the pixel P of the display panel 150. During the sampling period STP of the plurality of driving frames, the present threshold voltage Vth is repeatedly sensed and the sum Vda+Vth of the data voltage Vda and the threshold voltage Vth is stored in the storage capacitor Cs. During the plurality of staying frames of the plurality of driving frames, the driving TFT Td is switched by the sum Vda+Vth of the data voltage Vda and the threshold voltage Vth stored in the storage capacitor Cs to display an image.

The timing controlling part 120, the data driving part 130 and the gate driving part 140 operate to sense the threshold voltage Vth during the plurality of driving frames F1 to F(r) among the sixty frames constituting one second, and the timing controlling part 120, the data driving part 130 and the gate driving part 140 stop operating and display an image during the plurality of staying frames F(r+1) to F60. As a result, the power consumption is reduced.

Further, since the threshold voltage Vth is sensed by using the plurality of driving frames instead of one driving frame, the accuracy of sensing the present threshold voltage Vth is improved and the display quality of an image is improved due to reduction of a dark image or a blurred image.

The threshold voltage Vth of the driving TFT Td may be differently sensed according to the difference Vgs between the gate g and the source s of the driving TFT Td (i.e., the data voltage Vda applied to the source s).

For example, when the data voltage Vda of about 3V corresponding to a white, the difference Vgs between the gate g and the source s of the driving TFT Td may become a positive (+) value and the present threshold voltage Vth may be normally sensed. However, when the data voltage Vda of about 0 V corresponding to a black, the difference Vgs between the gate g and the source s of the driving TFT Td may become a negative (−) value and a value lower than the real threshold voltage may be sensed as the present threshold voltage Vth.

The variation in the sensed value is caused by a hysteresis of the driving TFT Td. Since the threshold voltage Vth is not accurately sensed due to the hysteresis during the initial sampling period STP, the number of the plurality of driving frames for an accurate sensing of the threshold voltage Vth increases and the effect of the reduction of the power consumption is reduced.

To address the above problems, the number of the plurality of driving frames for the sensing of the threshold voltage Vth may be reduced due to an artificial increase of the threshold voltage Vth by decreasing a length of the sampling period of the initial driving frame in another embodiment.

Figure 7:
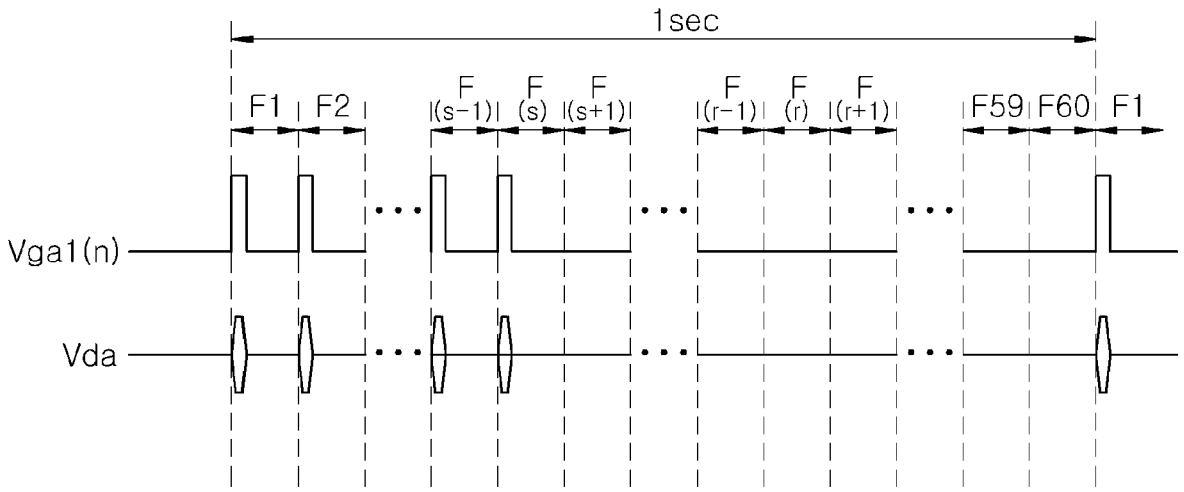
FIG. 7 is a view showing a primary gate voltage and a data voltage of a low frequency driving of an organic light emitting diode display device according to a second embodiment of the present disclosure.
Figure 8A:
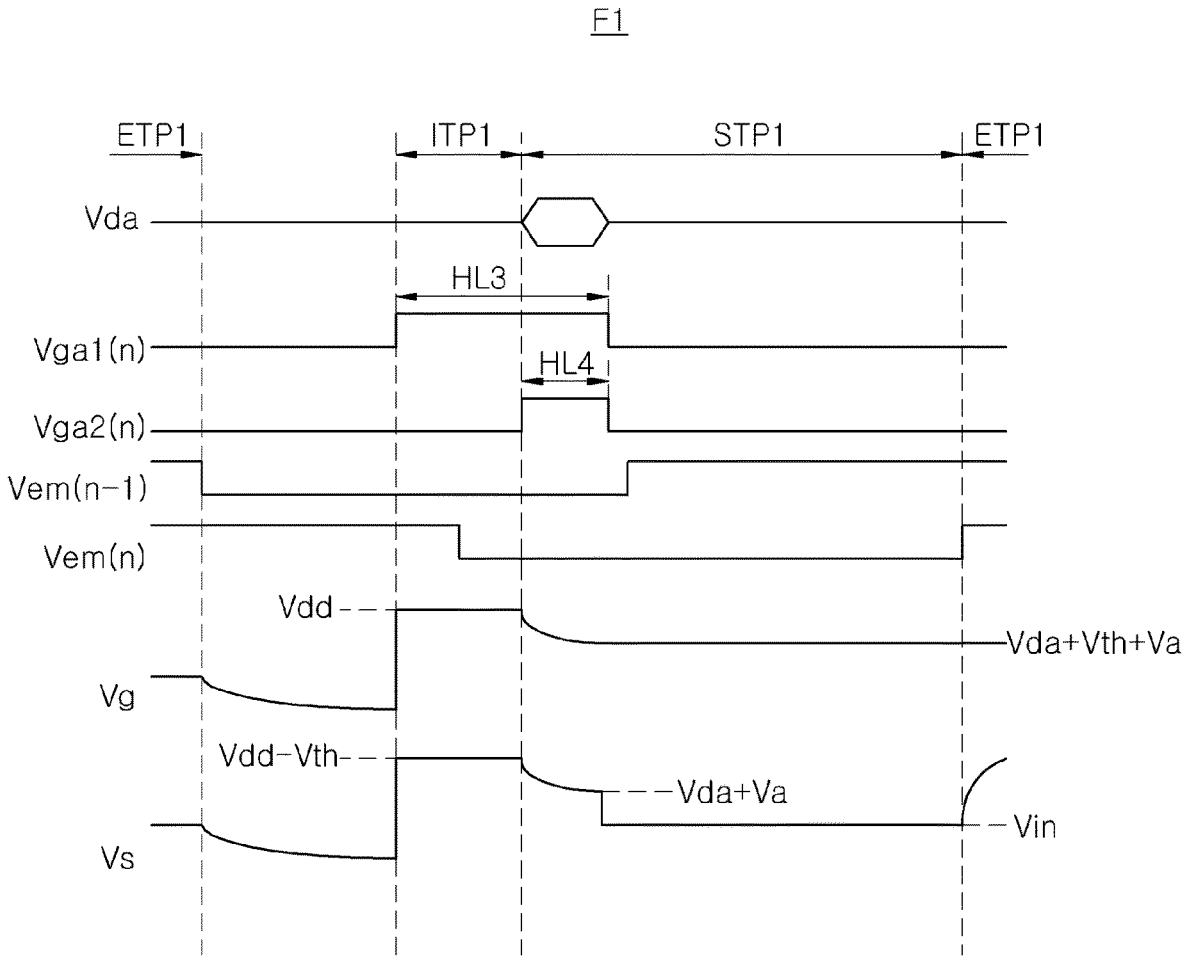
FIG. 8A is a view showing a plurality of voltages of an initial driving frame of the organic light emitting diode display device according to the second embodiment of the present disclosure.
Figure 8B:
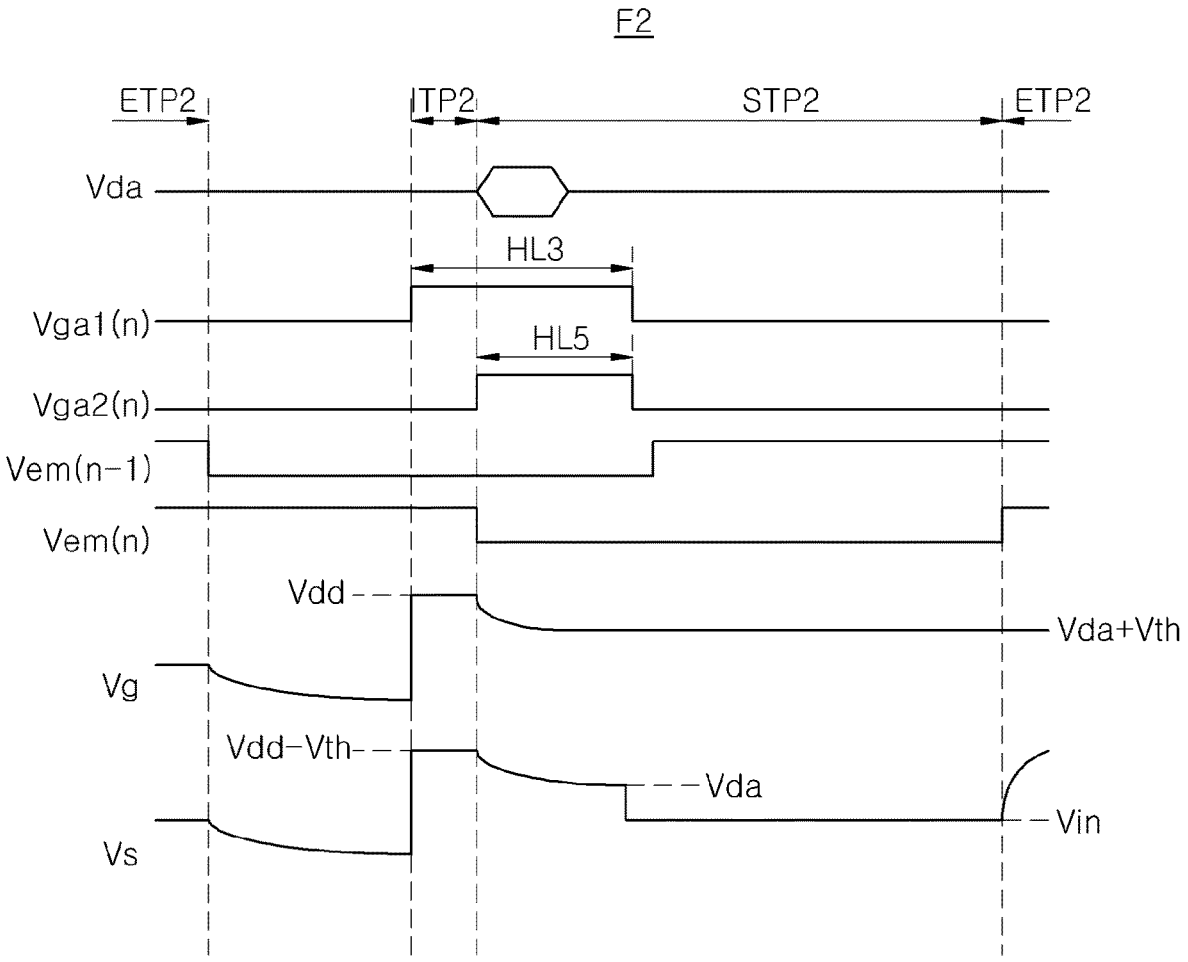
FIG. 8B is a view showing a plurality of voltages of one driving frame other than the initial driving frame of the organic light emitting diode display device according to the second embodiment of the present disclosure.

FIG. 7 is a view showing a primary gate voltage and a data voltage of a low frequency driving of an organic light emitting diode display device according to a second embodiment of the present disclosure, FIG. 8A is a view showing a plurality of voltages of an initial driving frame of the organic light emitting diode display device according to the second embodiment of the present disclosure, and FIG. 8B is a view showing a plurality of voltages of one driving frame other than the initial driving frame of the organic light emitting diode display device according to the second embodiment of the present disclosure. Since the structure of one/each pixel and the OLED display device of the second embodiment is the same as that of the first embodiment, some components of the second embodiment can be understood as being illustrated in FIGS. 2 and 3.

Referring to FIG. 7, when the OLED display device 110 is driven with a low frequency, during first to sth frames F1 to F(s), where s is an integer smaller than 60 and s is smaller than r of the first embodiment (s<r), among first to sixtieth frames F1 to F60 constituting one second, the nth primary gate voltage Vga1 (*n*) applied to the nth primary gate line GL1(*n*) of the display panel 150 has a high level and the data voltage Vda is applied to the data line DL of the display panel 150. During (s+1)th to sixtieth frames F(s+1) to F60, the nth primary gate voltage Vga1(*n*) has a low level and the pixel P of the display panel 150 consistently displays the same image using a sum Vdata+Vth of the data voltage Vda and the threshold voltage Vth stored in the storage capacitor Cs.

During the first to sth frames F1 to F(s) of a driving frame, the timing controlling part 120, the data driving part 130 and the gate driving part 140 operate to output the nth primary gate voltage Vga1(*n*) of a high level and the data voltage Vda. The nth primary gate voltage Vga1(*n*) of a high level and the data voltage Vda are supplied to the nth primary gate line GL1(*n*) and the data line DL, respectively, of the display panel 150. In addition, during the (s+1)th to sixtieth frames F(s+1) to F60 of a staying frame, the timing controlling part 120, the data driving part 130 and the gate driving part 140 stop operating and do not output the nth primary gate voltage Vga1(*n*) of a high level and the data voltage Vda. Since the nth primary gate voltage Vga1(*n*) of a high level and the data voltage Vda are not supplied to the nth primary gate line GL1(*n*) and the data line DL, respectively, power consumption of the OLED display device 110 may be reduced.

Further, the threshold voltage Vth is sensed during the first to sth frames F1 to F(s) of a driving frame. Since a length of a sampling period STP of the initial first frame is determined to be shorter than a length of at least one sampling period STP among the second to sth frames F2 to F(s), a present threshold voltage Vth is accurately detected by using the frame number s of the first to sth frames F1 to F(s) smaller than the frame number r of the first to rth frames F1 to F(r) of the first embodiment.

Here, the frame number s may be determined as a minimum frame number for accurately detecting the present threshold voltage Vth. For example, the frame s may be one of 2, 3 and 4.

In FIGS. 8A and 8B, the first frame F1 of a driving frame may include a first initialization period ITP1 for initializing elements such as the storage capacitor Cs, a first sampling period STP1 for sensing the threshold voltage and a first emission period ETP1 for emitting from the light emitting diode De. The second frame F2 of the driving frame may include a second initialization period ITP2 for initializing elements such as the storage capacitor Cs, a second sampling period STP2 for sensing the threshold voltage and a second emission period ETP2 for emitting from the light emitting diode De.

Here, the first and second frames F1 and F2 of a driving frame may be driven identically to each other except that lengths of the first and second initialization periods ITP1 and ITP2 are different from each other and lengths of the first and second sampling periods STP1 and STP2 are different from each other. Further, the third to sth frames F3 to F(s) may be driven identically to the second frame F2.

A length of the first initialization period ITP1 of the first frame F1 is greater than a length of the second initialization period ITP2 of the second frame F2, and a length of the first sampling period STP1 of the first frame F1 is smaller than a length of the second sampling period STP2 of the second frame F2. Specifically, the nth primary gate voltage Vga1(*n*) of the first frame F1 and the nth primary gate voltage Vga1(*n*) of the second frame F2 may have the same high level section HL3, and a length of a fourth high level section HL4 of the nth secondary gate voltage Vga2(*n*) of the first frame may be smaller than a length of a fifth high level section HL5 of the nth secondary gate voltage Vga2(*n*) of the second frame F2.

For example, the fourth high level section HL4 may be about 5% to about 30% of the third high level section HL3, and the fifth high level section HL5 may be about 40% to about 70% of the third high level section HL3. The fourth high level section HL4 may be about 10% to about 40% of the fifth high level section HL5, and the first sampling period STP1 may be about 70% to about 80% of the second sampling period STP2.

Here, when the fourth high level section HL4 is smaller than about 10% of the fifth high level section HL5, a brightness greater than a target brightness is displayed. When the fourth high level section HL4 is greater than about 40% of the fifth high level section HL5, a brightness smaller than a target brightness is displayed. As a result, a display quality of an image may be reduced.

Since the length of the first sampling period STP1 of the first frame F1 of an initial driving frame is determined to be smaller than the length of the second sampling period STP2 of the second frame F2 of one of the residual driving frames, a voltage stored in the storage capacitor Cs during the first frame F1 is greater than a voltage finally stored in the storage capacitor Cs. As a result, the threshold voltage Vth sensed during the first frame F1 may have a value greater than the threshold voltage Vth finally sensed.

During the first sampling period STP1, after the switching TFT Ts is turned on by the nth secondary gate voltage Vga2(*n*) of the high level, the driving TFT Td is kept to have a turn-on state till the voltage Vg of the gate g of the driving TFT Td decreases from the high level voltage Vdd to the sum Vda+Vth of the data voltage Vda and the threshold voltage Vth. The length of the first sampling period STP1 is determined to be relatively short so that the nth primary gate voltage Vga1(*n*) can become a low level and the driving TFT Td can be turned off before the voltage Vg of the gate g of the driving TFT Td becomes the sum Vda+Vth of the data voltage Vda and the threshold voltage Vth.

The voltage Vg of the gate g of the driving TFT Td decreases from the high level voltage Vdd. When the voltage Vg of the gate g of the driving TFT Td becomes a voltage Vda+Vth+a, where a is a relatively small arbitrary value, greater than the sum Vda+Vth of the data voltage Vda and the threshold voltage Vth, the current does not flow the driving TFT Td. As a result, the voltage Vda+Vth+a greater than the sum Vda+Vth of the data voltage Vda and the threshold voltage Vth is stored in the storage capacitor Cs.

The voltage Vth+a greater than the threshold voltage Vth due to the hysteresis of the driving TFT Td is sensed as a threshold voltage Vth by reducing the first sampling period STP1 of the initial first frame. As a result, the present threshold voltage Vth may be promptly and accurately sensed only by sensing the threshold voltages Vth during the second to sth frames F2 to F(s).

In the OLED display device 110 according to the second embodiment of the present disclosure, during the plurality of driving frames of the beginning of a low frequency driving, the primary gate voltage Vga1, the secondary gate voltage Vga2, the emission voltage Vem and the data voltage Vda are supplied to the pixel P of the display panel 150. During the sampling period STP of the plurality of driving frames, the present threshold voltage Vth is repeatedly sensed and the sum Vda+Vth of the data voltage Vda and the threshold voltage Vth is stored in the storage capacitor Cs. During the plurality of staying frames of the plurality of driving frames, the driving TFT Td is switched by the sum Vda+Vth of the data voltage Vda and the threshold voltage Vth stored in the storage capacitor Cs to display an image.

The timing controlling part 120, the data driving part 130 and the gate driving part 140 operate to sense the threshold voltage Vth during the plurality of driving frames F1 to F(s) among the sixty frames constituting one second, and the timing controlling part 120, the data driving part 130 and the gate driving part 140 stop operating and display an image during the plurality of staying frames F(s+1) to F60. As a result, the power consumption is reduced.

Further, since the threshold voltage Vth is sensed by using the plurality of driving frames instead of one driving frame, the accuracy of sensing the present threshold voltage Vth is improved and the display quality of an image is improved due to the reduction of a dark image or a blurred image.

In addition, since the sampling period of the initial driving frame among the plurality of driving frames is shortened, the voltage Vth+a greater than the threshold voltage Vth is sensed during the initial driving frame and the present threshold voltage Vth is promptly and accurately sensed during the residual driving frames.

Although the length of the first sampling period STP1 of the first frame F1 is smaller than the length of the second sampling period STP2 of the second frame F2 in the second embodiment, the lengths of the first and second sampling periods STP1 and STP2 of the first and second frames F1 and F2 may be the same as each other and each of the lengths of the first and second sampling periods STP1 and STP2 of the first and second frames F1 and F2 may be smaller than the length of the third sampling period STP3 of the third frame F3 in another embodiment.

Further, although the present disclosure is applied to the driving of the OLED display device in the first and second embodiments, the present disclosure may be applied to the driving of various display devices other than the OLED display device in other embodiment(s).

It will be apparent to those skilled in the art that various modifications and variations can be made in a display device and method of driving the same of the present disclosure without departing from the sprit or scope of the disclosure. Thus, it is intended that the present disclosure covers the modifications and variations of these aspects provided they come within the scope of the appended claims and their equivalents.

What is claimed is:

1. A display device comprising:

a driving unit configured to generate an nth primary gate voltage, an nth secondary gate voltage and a data voltage during a plurality of driving frames, where n is a positive integer; and a display panel configured to store a threshold voltage using the nth primary gate voltage, the nth secondary gate voltage and the data voltage during the plurality of driving frames, and display an image using a sum of the data voltage and the threshold voltage during a plurality of staying frames after the plurality of driving frames, wherein a sampling period for storing the threshold voltage of one of the plurality of driving frames is shorter than at least one sampling period of others of the plurality of driving frames, wherein, during the sampling period, a driving thin film transistor is turned on such that a current flows from a gate to a source through a drain of the driving thin film transistor, and then a driving thin film transistor is turned off such that a voltage of the gate of the driving thin film transistor is stored in a storage capacitor, wherein the plurality of driving frames include first to sth frames among first to sixtieth frames constituting one second and the plurality of staying frames include (s+1)th frames to sixtieth frames, where s is one of 2, 3 and 4, wherein the driving unit operates to output the data voltage during the first to sth frames and stops operating not to output the data voltage during the (s+1)th to sixtieth frames, wherein the one of the plurality of driving frames is an initial driving frame of the plurality of driving frames, wherein the initial driving frame of the plurality of driving frames includes a first initialization period for initializing a storage capacitor, a first sampling period for sensing the threshold voltage and a first emission period for emitting a light from an emission part, wherein the at least one of the others of the plurality of driving frames includes a second initialization period for initializing the storage capacitor, a second sampling period for sensing the threshold voltage and a second emission period for emitting a light from the emission part, wherein nth primary gate voltage has a high level during a first high level section of the first initialization period, the first sampling period, the second initialization period and the second sampling period, and wherein the nth secondary gate voltage has the high level during a second high level section of the first sampling period and has the high level during a third high level section of the second sampling period longer than the second high level section.

2. The display device of claim 1, wherein the driving unit generates an nth emission voltage and an (n−1)th emission voltage, and the display panel uses the nth emission voltage and the (n−1)th emission voltage for sensing the threshold voltage.

3. A display device comprising:

a driving unit configured to generate an nth primary gate voltage, an nth secondary gate voltage and a data voltage during a plurality of driving frames, where n is a positive integer; and a display panel configured to store a threshold voltage using the nth primary gate voltage, the nth secondary gate voltage and the data voltage during the plurality of driving frames, and display an image using a sum of the data voltage and the threshold voltage during a plurality of staying frames after the plurality of driving frames, wherein a sampling period for storing the threshold voltage of one of the plurality of driving frames is shorter than at least one sampling period of others of the plurality of driving frames, wherein the display panel comprises:

a first thin film transistor being switched according to the nth primary gate voltage and receiving an initialization voltage;

a second thin film transistor being switched according to the nth primary gate voltage;

a third thin film transistor being switched according to an nth emission voltage for sensing the threshold voltage and receiving a high level voltage;

a fourth thin film transistor being switched according to an (n−1)th emission voltage for sensing the threshold voltage;

a switching thin film transistor being switched according to the nth secondary gate voltage and receiving the data voltage;

a driving thin film transistor connected to the second to fourth thin film transistors;

a storage capacitor connected to the first thin film transistor and the driving thin film transistor; and an emission part connected to the fourth thin film transistor and receiving a low level voltage.

4. The display device of claim 3, wherein the one of the plurality of driving frames is an initial driving frame of the plurality of driving frames, wherein the initial driving frame of the plurality of driving frames includes a first initialization period for initializing the storage capacitor, a first sampling period for sensing the threshold voltage and a first emission period for emitting a light from the emission part, and wherein the at least one of the others of the plurality of driving frames includes a second initialization period for initializing the storage capacitor, a second sampling period for sensing the threshold voltage and a second emission period for emitting a light from the emission part.

5. The display device of claim 4, wherein the nth primary gate voltage has a high level during a first high level section of the first initialization period, the first sampling period, the second initialization period and the second sampling period, and wherein the nth secondary gate voltage has the high level during a second high level section of the first sampling period and has the high level during a third high level section of the second sampling period longer than the second high level section.

6. The display device of claim 5, wherein the second high level section is approximately 10% to 40% of the third high level section.

7. A method of driving a display device, the method comprising:

generating an nth primary gate voltage, an nth secondary gate voltage and a data voltage during a plurality of driving frames, where n is a positive integer;

sensing a threshold voltage using the nth primary gate voltage, the nth secondary gate voltage and the data voltage during the plurality of driving frames; and displaying an image using a sum of the data voltage and the threshold voltage during a plurality of staying frames after the plurality of driving frames, wherein a sampling period of one of the plurality of driving frames is shorter than at least one sampling period of others of the plurality of driving frames, wherein the one of the plurality of driving frames is an initial driving frame of the plurality of driving frames, wherein the initial driving frame of the plurality of driving frames includes a first initialization period for initializing a storage capacitor, a first sampling period for sensing the threshold voltage and a first emission period for emitting a light from an emission part, wherein the at least one of the others of the plurality of driving frames includes a second initialization period for initializing the storage capacitor, a second sampling period for sensing the threshold voltage and a second emission period for emitting a light from the emission part, wherein the nth primary gate voltage has a high level during a first high level section of the first initialization period, the first sampling period, the second initialization period and the second sampling period, and wherein the nth secondary gate voltage has the high level during a second high level section of the first sampling period and has the high level during a third high level section of the second sampling period longer than the second high level section.

8. The method of claim 7, wherein the second high level section is approximately 10% to 40% of the third high level section.

9. The method of claim 7, wherein, during the sampling period, a driving thin film transistor is turned on such that a current flows from a gate to a source through a drain of the driving thin film transistor, and then a driving thin film transistor is turned off such that a voltage of the gate of the driving thin film transistor is stored in a storage capacitor, wherein the plurality of driving frames include first to sth frames among first to sixtieth frames constituting one second and the plurality of staying frames include (s+1)th frames to sixtieth frames, where s is one of 2, 3 and 4, and wherein the driving unit operates to output the data voltage during the first to sth frames and stops operating not to output the data voltage during the (s+1)th to sixtieth frames.

10. The method of claim 7, wherein the generating the nth primary gate voltage, the nth secondary gate voltage and the data voltage includes generating an nth emission voltage and an (n−1)th emission voltage, and wherein the sensing the threshold voltage includes sensing the threshold voltage using the nth emission voltage and the (n−1)th emission voltage.

* * * * *